United States Patent [19]

Schmid

[11] 4,084,628

[45] Apr. 18, 1978

[54] CONVEYOR APPARATUS FOR DELIVERING FLUX POWDER TO THE MOLD OF A CONTINUOUS CASTING INSTALLATION

[75] Inventor: Markus Schmid, Zurich, Switzerland

[73] Assignee: Concast AG, Zurich, Switzerland

[21] Appl. No.: 740,926

[22] Filed: Nov. 11, 1976

[30] Foreign Application Priority Data

Nov. 27, 1975 Switzerland ..... 15396/75

[51] Int. Cl.[2] ..... B65B 3/10

[52] U.S. Cl. ..... 141/284; 164/420; 302/12

[58] Field of Search ..... 141/70, 100, 1, 4–12, 141/67, 68, 69, 101–107, 192–198, 234–248, 250–255, 256–284, 285; 198/752; 302/11, 12, 13; 164/4, 281

[56] References Cited

U.S. PATENT DOCUMENTS

| | | | |
|---|---|---|---|
| 1,162,221 | 11/1915 | Cayen | 302/13 |
| 1,478,395 | 12/1923 | Pierce | 302/11 |
| 2,795,318 | 6/1957 | Morris | 198/752 |
| 3,900,065 | 8/1975 | Giunta et al. | 164/420 |
| 3,970,135 | 7/1976 | Schmid et al. | 164/4 |

FOREIGN PATENT DOCUMENTS

| | | | |
|---|---|---|---|
| 39,290 | 9/1928 | Denmark | 302/13 |
| 466,080 | 3/1950 | Italy | 302/11 |

*Primary Examiner*—Houston S. Bell, Jr.
*Attorney, Agent, or Firm*—Werner W. Kleeman

[57] ABSTRACT

A conveyor apparatus for delivering flux powder to the mold of a continuous casting installation for metals, especially steel, comprising two powder containers, a pneumatic conveyor means arranged between a supply container having large capacity and disposed externally of the direct servicing or operating region of the continuous casting mold and a container at the region of such mold having relatively small capacity. The pneumatic conveyor means conveys the flux powder by means of a pneumatic transport or conveying agent to the container of small capacity where the pneumatic conveying agent is expelled. A mechanical conveyor means extends from the container of relatively small capacity at the region of the mold to a location above the level of the metal bath in the continuous casting mold.

12 Claims, 1 Drawing Figure

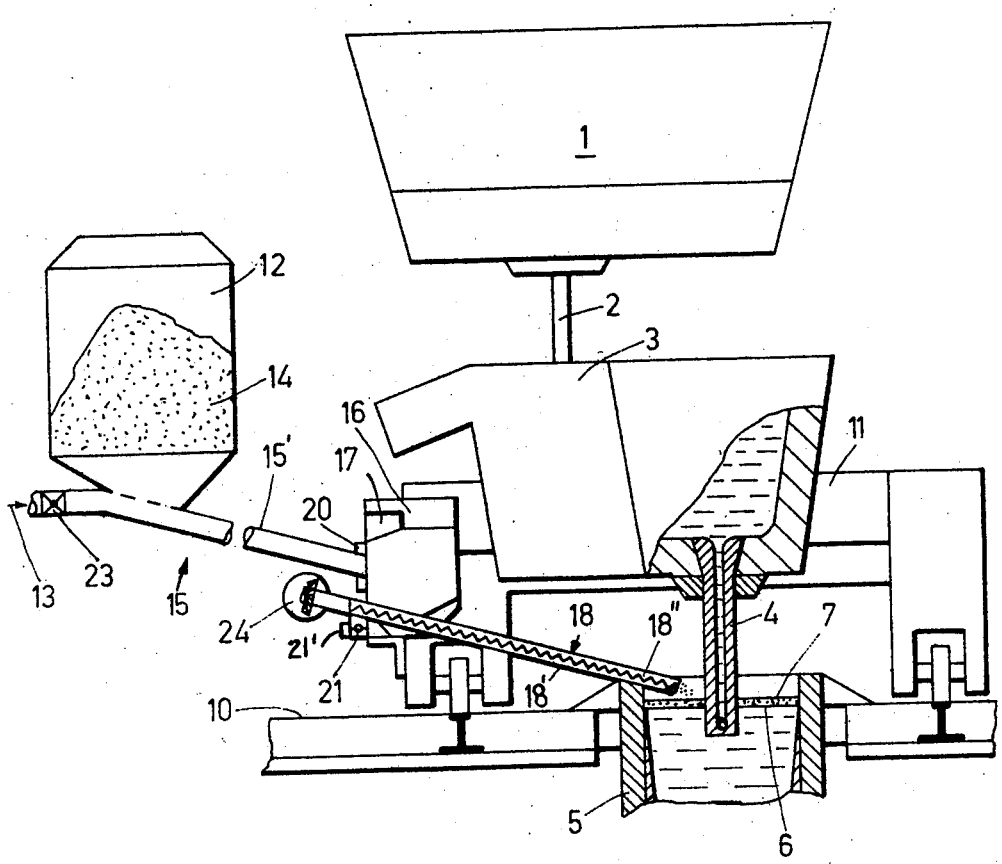
1
2
3
4
5
6
7
10
11
12
13
14
15
15'
16
17
18
18'
18"
20
21
21'
23
24

CONVEYOR APPARATUS FOR DELIVERING FLUX POWDER TO THE MOLD OF A CONTINUOUS CASTING INSTALLATION

BACKGROUND OF THE INVENTION

The present invention relates to a new and improved construction of conveyor apparatus for delivering flux powder to a mold of a continuous casting installation for metals, especially steel.

It has already been proposed for a continuous casting installation to transport the flux powder from a supply container by means of a mechanical worm conveyor directly into the continuous casting mold. However, with this solution there is present the drawback that a large supply container must be erected at the casting platform at the region of the mold and the worm conveyor must be guided by means of bends or the like. The erection of such supply container limits the available space, on the one hand, causing poor accessibility at the casting platform and, on the other hand, due to the curved construction of the worm conveyor, increased wear of the worm results, so that it must be frequently exchanged. Hence, this proposal is both complicated and expensive.

Further, it is already known to the art to deliver flux powder from a first container by means of a trough to a second approximately equal size, lower situated container. The second container cooperates with a vibration device and a transport device. The powder is conveyed from the transport device by means of air to the surface of the metal bath in the continuous casting mold. However, this arrangement is associated with the disadvantage that the infeed of the flux powder by means of air into the hollow compartment of the mold is associated with the danger of oxidation of the steel and there occurs an undesirable dust formation which obstructs the view into the mold.

SUMMARY OF THE INVENTION

With the foregoing in mind, it is therefore a primary object of the present invention to provide a new and improved construction of conveyor apparatus for delivering flux powder to the mold of a continuous casting installation in a manner not associated with the aforementioned drawbacks and limitations of the prior art proposals.

Another and more specific object of the present invention aims at overcoming the drawbacks of the state-of-the-art powder infeed devices and to provide a conveyor apparatus which permits good accessibility at the casting platform and a disturbance-free, especially dust-free infeed of flux powder with good distribution thereof in the mold.

Still a further object of the present invention aims at the provision of a conveyor apparatus of the previously mentioned type which is both inexpensive and not readily subject to breakdown or malfunction.

Another significant object of the present invention aims at providing a novel construction of conveyor apparatus which enables delivering flux powder to the mold of a continuous casting installation in a reliable and efficient manner, while providing good accessibility to the region around the continuous casting mold.

Now in order to implement these and still further objects of the invention, which will become more readily apparent as the description proceeds, the conveyor apparatus of the present invention comprises two powder containers, one of which has a large capacity for the flux powder and the other of which has a relatively small capacity. A pneumatic conveyor means is arranged between the supply container of large capacity externally of the direct servicing or operating region at the mold and the container of relatively small capacity which is arranged at the region of the continuous casting mold. Mechanical conveyor means deliver the flux powder from the container at the region of the mold to a location above the level of the molten bath in the mold.

Continuing according to the invention, the supply container of large capacity can be arranged externally of the direct operating region about the mold at a suitable location, for instance, stationarily mounted at the casting platform at a suitable distance from the mold. The pneumatic conveying of the powder can be accomplished also over long distances and through curved paths without any great difficulty. Consequently, a notable improvement is achieved with regard to the available space at the casting platform, especially at the direct region of the continuous casting mold, and there is reduced the danger of accidents caused for instance, by infeed lines which have been laid at the floor of the casting platform. The intermediate container for the flux powder supply at the region of the mold can be designed to be relatively small, since it need only accommodate a limited quantity of flux powder and, in particular, must only separate-out the conveying or transport gas for the flux powder. From the region of this small supply container located at the neighborhood of the mold, there is carried out a mechanical conveying of the flux powder to the region above the molten metal bath in the mold, upon which there is deposited the flux powder. Such conveying of the flux powder now is accomplished over a short, preferably linear path, so that the mechanical components are only subjected to very little loading or wear and there is thus realized increased service life. Due to this mechanical conveying of the flux powder, there is also achieved a relatively dust free infeed so that the visual conditions for the operator observing the mold are improved. The pneumatic conveying of the flux powder can be advantageously carried out with the aid of air, and such conveying medium can readily escape from the container located at the region of the continuous casting mold. The subsequent mechanical conveying of the flux powder can be accomplished by means of an essentially straight conveyor trough and a conveyor worm cooperating therewith.

In order to further improve the space conditions at the casting platform, it is possible, in the case of continuous casting installations equipped with tundish carriages, to mount the small supply container at such tundish carriage. The capacity of the smaller supply container for the flux powder should advantageously amount to about 5–15 kg powder. To insure a uniform charging of the mold with the flux powder, the mechanical conveying of the same can be carried out by means of a number of essentially similar troughs and these troughs advantageously can be positionally shifted with respect to the molten metal bath, in order to apply a uniformly thick layer of the flux powder thereon. This can be accomplished by laterally rocking or shifting the trough in an essentially horizontal plane. In order to be able to exactly regulate the infed quantity of flux powder as a function of the prevailing requirements, the conveyor arrangement can be additionally provided with a standard dosing device or dosing means, wherein in the case of pneumatic conveying of the flux powder, such dosing means, for instance, can be a valve for the conveying or transport air and in the case of the mechanical conveying of the flux powder, such dosing means can be, for instance, a controlled motor with a transmission for the conveyor worm.

BRIEF DESCRIPTION OF THE DRAWING

The invention will be better understood and objects other than those set forth above will become apparent when consideration is given to the following detailed description thereof. Such description makes reference to the annexed drawing wherein the single FIGURE schematically illustrates in front view, a preferred embodiment of conveyor apparatus for flux powder in conjunction with an only partially illustrated continuous casting installation.

DETAILED DESCRIPTION OF THE PREFERRED EMBODIMENTS

Describing now the drawing, it is to be understood that in order to simplify the illustration thereof only enough of the structure of the continuous casting installation has been shown to enable those skilled in the art to readily understand the underlying concepts and principles of the invention. Hence, it will be recognized that the teemed metal, typically steel 2 flows from a ladle 1 into a tundish 3. As is conventional in this art, by means of a pouring tube 4, the steel is introduced into the liquid casting head or molten metal pool contained in the continuous casting mold 5. The bath level 6 in the continuous casting mold 5 is covered with a flux powder- and slag layer 7. The tundish 3 is mounted at a tundish carriage 11 conventionally movable upon the casting platform 10, tundish carriage 11 serving to displace the tundish 3 into the casting position prior to the start of the continuous casting operation. Conventional, and therefore not particularly illustrated lifting means for the tundish 3 are provided at the tundish carriage 11 in order to immerse the pouring tube 4 in the hollow compartment or cavity of the mold 5.

During the casting operation, flux powder must be continuously supplied to the molten bath level or surface 6 of the steel in the continuous casting mold 5. Thus, flux powder 14 is conveyed from a supply container 12 of large capacity, for instance, capable of handling several tons of such powder, arranged externally of the direct operating region or servicing area of the mold 5 to a container 16 located at the region of the mold 5. Conveying of the flux powder 14 from the larger size container 12 to the smaller size container 16 is accomplished by infeeding air, as schematically indicated by reference character 13, which serves as the pneumatic conveying or transport agent, through a pneumatic conveyor means 15 embodying a conveyor or conveying tube 15'. The smaller size container 16 possesses a relatively small capacity, but in any event should be capable of holding at least a quantity of flux powder adequate for handling a charge of molten metal to be cast. Dosing of the conveyed quantity of flux powder occurs, by way of example, by means of a regulating valve 23 for the conveying air. In the container 16 the conveying air is separated and escapes through an opening 17. The smaller container 16, which has a capacity of about 5 to 15 kg is mounted at the tundish carriage 11, at the side facing away from the mold-operating personnel and in close proximity to such mold. Hence, it will be appreciated that the container 16 can be moved along with the tundish carriage 11.

For this purpose, there is provided between the pneumatic conveyor means 15 and the container 16 a quickly releasable coupling 20. From the location of the container 16 the flux powder is conveyed by means of at least one substantially straight mechanical conveyor 18 having a conventional conveyor worm or screw 18'' located in a conveyor trough or tube 18', to a location above the molten bath level 6 in the continuous casting mold. Further, dosing of the thus conveyed flux powder is carried out by means of a suitable regulatable drive motor 24 cooperating with the conveyor worm 18''. Owing to the linearity of the mechanical conveying or conveyor means 18 it is possible to appreciably increase its service life. Depending upon the requirements for flux powder and depending upon the shape of the strand to be produced, it is possible to provide one or a number of such mechanical conveyors. For the uniform distribution of the flux powder upon the surface of the bath level, the troughs or tubes 18' can be shifted in position with respect to the bath level. This can be achieved, for instance, by rocking each such trough or the like in a horizontal plane about the hinge means 21 with the aid of the schematically illustrated pivot device 21'.

The invention of course is not limited to the illustrated exemplary embodiment. Thus, when utilizing the system in a multi-strand casting installation, the supply container 12 can supply a number of containers 16 with flux powder, each of the containers 16 being associated with one of the continuous casting molds of the multi-strand continuous casting installation. Further, it is also possible to provide, for instance, a number of supply containers which contain flux powders of different compositions. For casting a certain steel quality, it is then possible to pneumatically convey in each case the most suitable powder from the relevant supply container to the container located at the neighborhood of the mold. Equally, the system can be operated such that during casting, different powders can be applied, for instance, flux powders possessing different melting behavior at the start of casting and at some time during the course of casting respectively. These different flux powders can also be stored in a sub-divided supply container having a number of conveyor troughs or tubes leading to the container at the region of the mold. It is also possible to admix individual types of powders in front of such container and which powders emanate from different supply containers or compartments.

While there are shown and described present preferred embodiments of the invention, it is to be distinctly understood that the invention is not limited thereto, but may be otherwise variously embodied and practiced within the scope of the following claims. Accordingly,

What is claimed is:

1. A conveyor apparatus for delivering flux powder to the molten bath level of a mold of a continuous casting installation for metals, especially steel, comprising:
   - a supply container for flux powder;
   - a container for receiving the flux powder from said supply container;
   - said supply container possessing a larger capacity for flux powder than said receiving container;
   - said supply container being located externally of the direct servicing region of the mold;

said receiving container being located at the neighborhood of the mold;

pneumatic conveyor means interposed between said supply container and said receiving container for delivering by means of a pneumatic conveying agent flux powder from the supply container to said receiving container; and mechanical conveyor means for delivering the flux powder from said receiving container at the neighborhood of the mold to a region above the molten bath level in said mold.

2. The conveyor apparatus according to claim 1, wherein said pneumatic conveyor means comprises a conveyor tube and said pneumatic conveying agent is air.

3. The conveyor apparatus according to claim 1, wherein said mechanical conveyor means comprises an essentially straight conveyor trough and a conveyor worm cooperating with said conveyor trough.

4. The conveyor apparatus according to claim 1, further including a tundish carriage provided for the continuous casting installation, said receiving container being mounted at said tundish carriage.

5. The conveyor apparatus according to claim 1, wherein said receiving container for the flux powder has a capacity of about 5 to 15 kg flux powder.

6. The conveyor apparatus according to claim 1, wherein the mechanical conveyor means includes at least one conveyor element for conveying the flux powder into the mold.

7. The conveyor apparatus according to claim 6, wherein said conveyor element is a conveyor trough.

8. The conveyor apparatus according to claim 6, including a plurality of said conveyor elements for conveying flux powder into the mold.

9. The conveyor apparatus according to claim 6, further including means for shifting the conveyor element with respect to the molten bath level in the mold.

10. The conveyor apparatus according to claim 1, wherein at least one of said conveyor means is provided with a dosing device.

11. The conveyor apparatus according to claim 10, wherein said dosing device comprises a valve provided for said pneumatic conveyor means.

12. The conveyor apparatus according to claim 10, wherein the dosing device comprises a regulatable drive motor provided for said mechanical conveyor means.

* * * * *